US005547156A

United States Patent [19]

Djuric

[11] Patent Number: 5,547,156

[45] Date of Patent: Aug. 20, 1996

[54] SLIDING HOLDER FOR A CURTAIN

[76] Inventor: Zoran Djuric, 100 Wingarden Ct., #116, Scarborough, Ontario, Canada, MIB 2P4

[21] Appl. No.: 334,941

[22] Filed: Nov. 7, 1994

[51] Int. Cl.[6] ..... A47H 13/12

[52] U.S. Cl. ..... 248/307; 248/340; 16/87.4 R; 16/93 D; 211/94.5; 211/162; 160/345

[58] Field of Search ..... 248/261, 307, 248/317, 339, 340, 223.41, 298.1; 160/38, 330, 345; 211/94, 162, 94.5; 16/87.4, 93 D, 95 D, 87.4 W, 87.4 R

[56] References Cited

U.S. PATENT DOCUMENTS

| | | | |
|---|---|---|---|
| 699,971 | 5/1902 | Poschmann | 16/87.4 |
| 1,060,426 | 4/1913 | Carlson | 248/307 X |
| 2,787,435 | 4/1957 | Shields | 248/307 |
| 3,262,148 | 7/1966 | Saltz | 16/93 D X |
| 4,282,630 | 8/1981 | Toder | 248/307 X |

FOREIGN PATENT DOCUMENTS

| | | | |
|---|---|---|---|
| 884709 | 11/1971 | Canada | 160/38 |
| 910459 | 6/1946 | France | 160/38 |
| 2115535 | 10/1972 | Germany | 16/87.4 |
| 2416682 | 11/1974 | Germany | 16/93 D |
| 2823217 | 5/1979 | Germany | 211/162 |
| 387827 | 2/1933 | United Kingdom | 160/38 |

*Primary Examiner*—Alvin C. Chin-Shue
*Assistant Examiner*—Brian J. Hamilla

[57] ABSTRACT

A holder for supporting a curtain relative to a wall or ceiling surface. The inventive device includes an elongated support plate mountable to a wall or ceiling surface and having a pair of retaining channels extending therealong. A plurality of sliding hooks are movably positioned within the channel and extend downwardly from the support plate to couple with a curtain.

1 Claim, 3 Drawing Sheets

SLIDING HOLDER FOR A CURTAIN

BACKGROUND OF THE INVENTION

1. Field of the Invention

The present invention relates to curtain rod structures and more particularly pertains to a sliding holder for a curtain for supporting a curtain relative to a wall or ceiling surface.

2. Description of the Prior Art

The use of curtain rod structures is known in the prior art. More specifically, curtain rod structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art curtain rod structures include U.S. Pat. No. 5,039,049; U.S. Pat. No. 5,028,027; U.S. Pat. No. 4,828,002; U.S. Pat. No. 5,259,687; and U.S. Pat. No. 4,031,943.

While these devices fulfill their respective, particular objectives and requirements, the aforementioned patents do not disclose a sliding holder for a curtain for supporting a curtain relative to a wall or ceiling surface which includes an elongated support plate mountable to a wall or ceiling surface and having at least one retaining channel extending therealong, with a plurality of sliding hooks movably positioned within the channel and extending downwardly from the support plate to couple with a curtain to support the same relative to the wall or ceiling surface.

In these respects, the sliding holder for a curtain according to the present invention substantially departs from the conventional concepts and designs of the prior art, and in so doing provides an apparatus primarily developed for the purpose of supporting a curtain relative to a wall or ceiling surface proximal to a window.

SUMMARY OF THE INVENTION

In view of the foregoing disadvantages inherent in the known types of curtain rod structures now present in the prior art, the present invention provides a new sliding holder for a curtain construction wherein the same can be utilized for supporting a curtain relative to a wall or ceiling surface. As such, the general purpose of the present invention, which will be described subsequently in greater detail, is to provide a new sliding holder for a curtain apparatus and method which has many of the advantages of the curtain rod structures mentioned heretofore and many novel features that result in a sliding holder for a curtain which is not anticipated, rendered obvious, suggested, or even implied by any of the prior art curtain rod structures, either alone or in any combination thereof.

To attain this, the present invention generally comprises a holder for supporting a curtain relative to a wall or ceiling surface. The inventive device includes an elongated support plate mountable to a wall or ceiling surface and having at least one retaining channel extending therealong. A plurality of sliding hooks are movably positioned within the channel and extend downwardly from the support plate to couple with a curtain.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sliding holder for a curtain apparatus and method which has many of the advantages of the curtain rod structures mentioned heretofore and many novel features that result in a sliding holder for a curtain which is not anticipated, rendered obvious, suggested, or even implied by any of the prior art curtain rod structures, either alone or in any combination thereof.

It is another object of the present invention to provide a new sliding holder for a curtain which may be easily and efficiently manufactured and marketed.

It is a further object of the present invention to provide a new sliding holder for a curtain which is of a durable and reliable construction.

An even further object of the present invention is to provide a new sliding holder for a curtain which is susceptible of a low cost of manufacture with regard to both materials and labor, and which accordingly is then susceptible of low prices of sale to the consuming public, thereby making such sliding holder for a curtain economically available to the buying public.

Still yet another object of the present invention is to provide a new sliding holder for a curtain which provides in the apparatuses and methods of the prior art some of the advantages thereof, while simultaneously overcoming some of the disadvantages normally associated therewith.

Still another object of the present invention is to provide a new sliding holder for a curtain for supporting a curtain relative to a wall or ceiling surface and proximal to a window structure.

Yet another object of the present invention is to provide a new sliding holder for a curtain which includes an elongated support plate mountable to a wall or ceiling surface and having at least one retaining channel extending therealong, with a plurality of sliding hooks movably positioned within the channel and extending downwardly from the support plate to couple with a curtain to support the same relative to the wall or ceiling surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
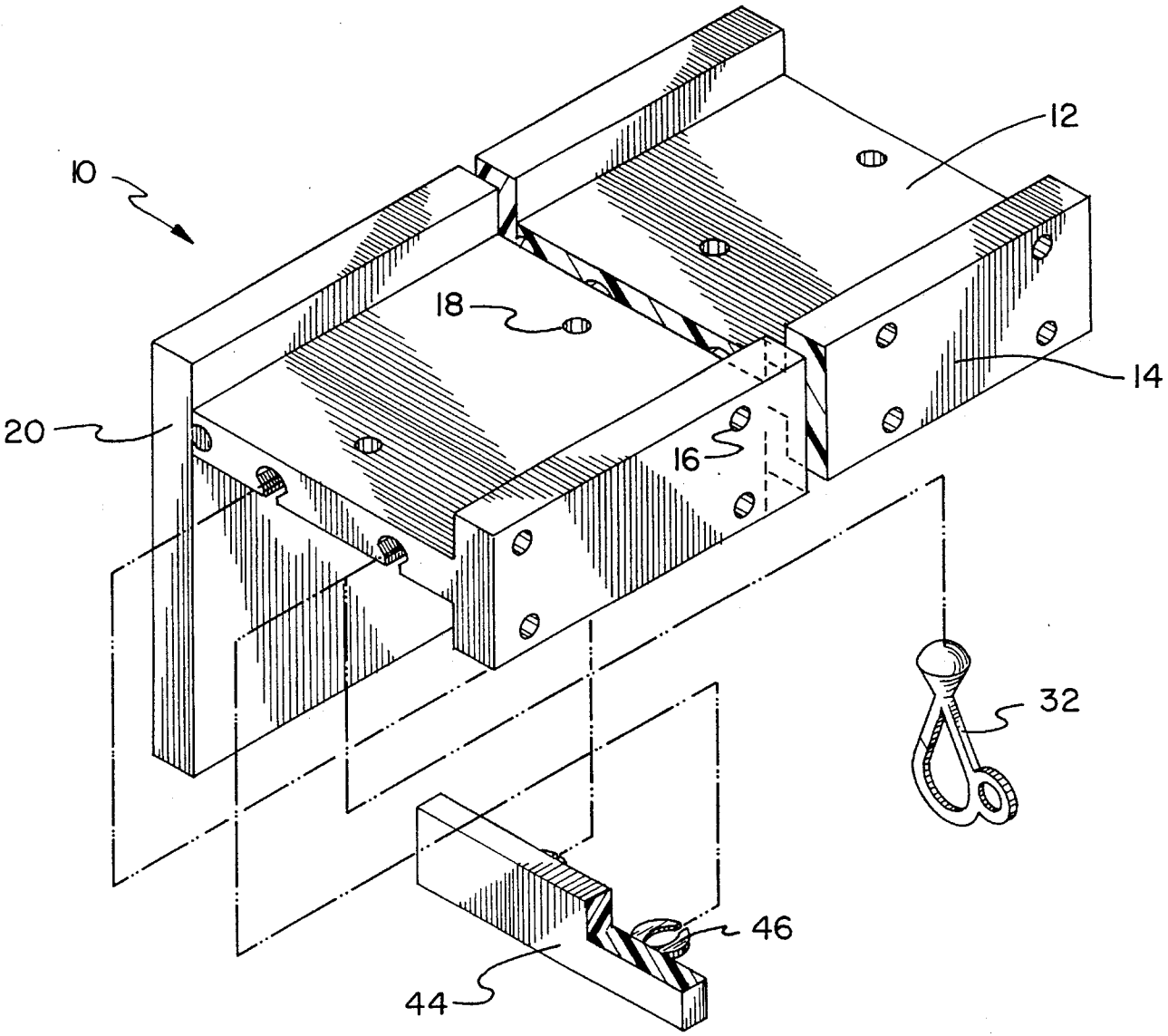
FIG. 1 is an isometric illustration, partially exploded, of a sliding holder for a curtain according to the present invention.
Figure 2:
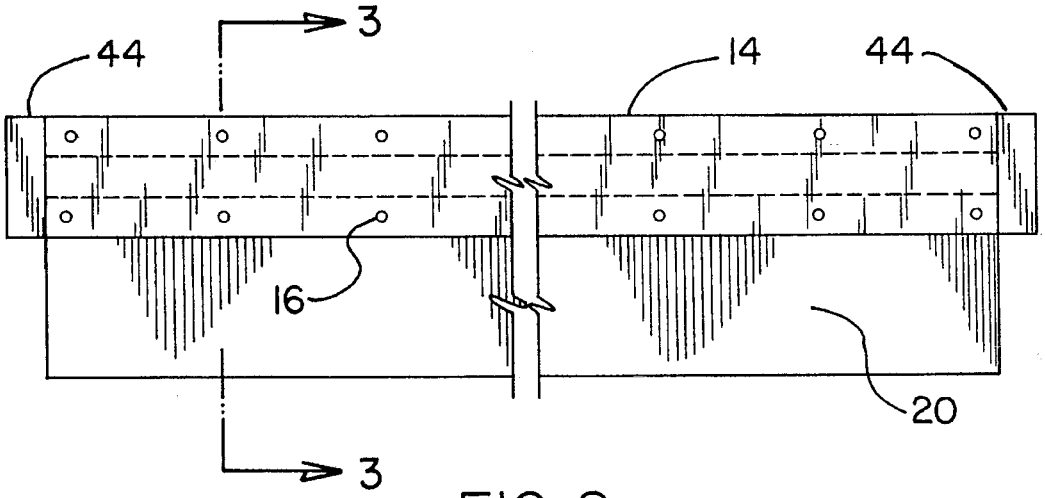
FIG. 2 is a rear elevation view of the invention.

With reference now to the drawings, and in particular to FIGS. 1–7 thereof, a new sliding holder for a curtain embodying the principles and concepts of the present invention and generally designated by the reference numeral 10 will be described.

Figure 3:
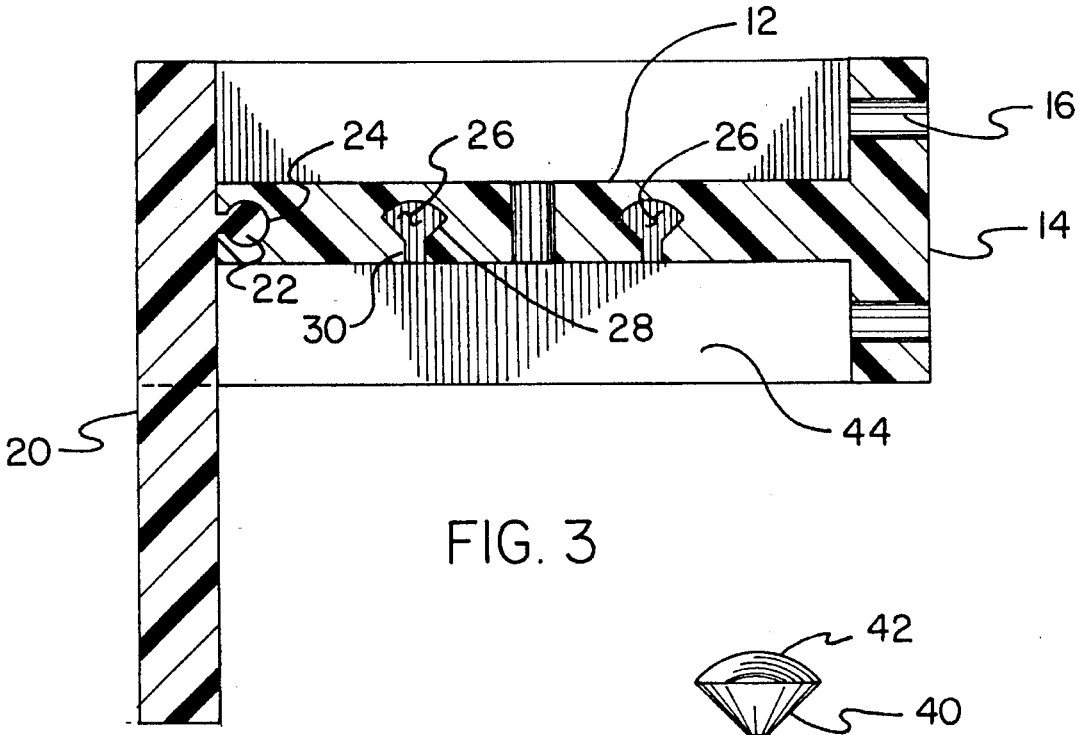
FIG. 3 s a cross-sectional view taken along line 3—3 of FIG. 2.
Figure 5:
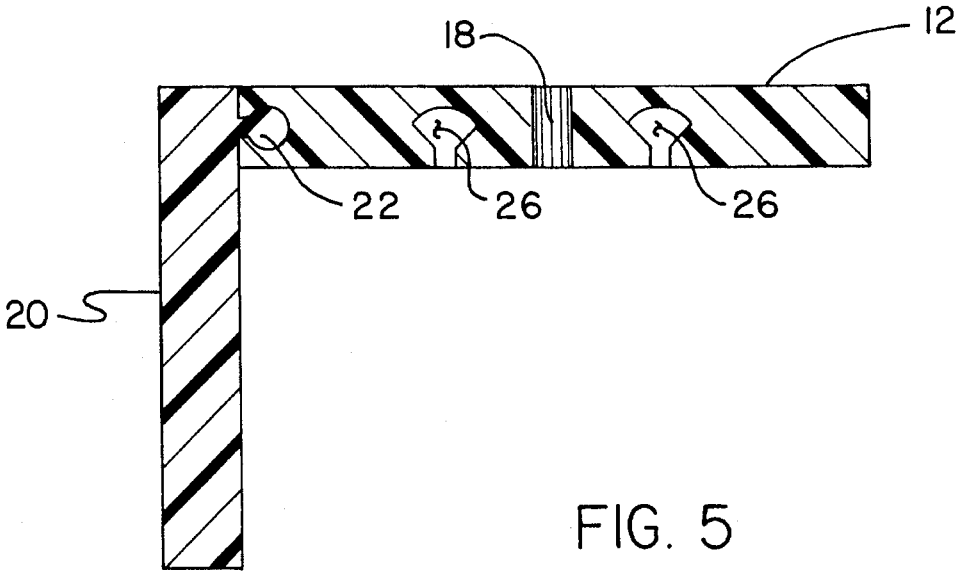
FIG. 5 is a cross-sectional view of an alternative form of the present invention.
Figure 6:
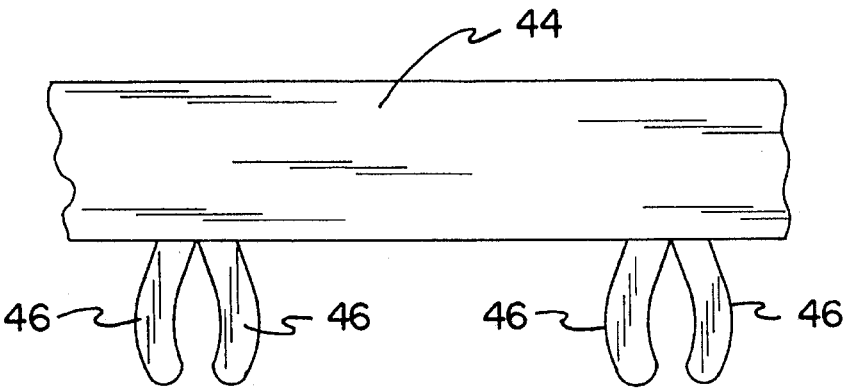
FIG. 6 is a top plan view of an end cap forming a portion of the present invention.
Figure 7:
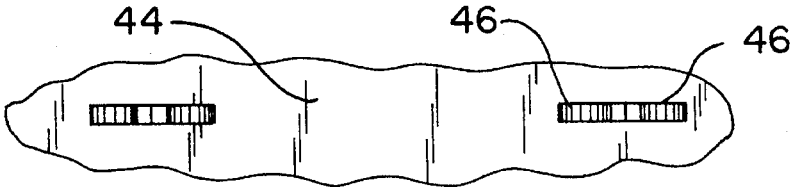
FIG. 7 is a side elevation view of a portion of the end cap.

More specifically, it will be noted that the sliding holder for a curtain 10 comprises a substantially elongated support plate 12 having a first longitudinal side spaced from a second longitudinal side. The longitudinal sides of the support plate 12 extend in a substantially parallel relationship to one another to define a substantially rectangular shape of the support plate. A mounting plate 14 extends along the first longitudinal side of the support plate 12 and is integrally or otherwise fixedly secured thereto. As shown in FIG. 3, the mounting plate 14 extends both above and below the support plate 12 and includes a plurality of through-extending mounting apertures 16 which permit the direction of threaded fasteners or the like therethrough to secure the mounting plate 14 and the projecting support plate 12 relative to a vertical wall surface. To permit mounting of the support plate 12 to a ceiling surface, a plurality of support plate apertures 18 extend through the support plate 12 and permit the direction of threaded fasteners or other fastening means therethrough which can engage and secure the ceiling surface to join the support plate 12 thereto with suitable spacing means interposed therebetween. As shown in FIG. 5, the support plate 12 can be constructed without the mounting plate 14 extending along the first longitudinal side thereof such that the support plate apertures 18 permit a direct coupling of the support plate 12 in an abutting relationship relative to a ceiling surface or other bracket structure.

Extending substantially parallel to the mounting plate 14 and depending downwardly from the support plate 12 is a valance 20 which is removably coupled to the second longitudinal side of the support plate. To this end, the valance 20 includes a cylindrical projection 22 extending along a longitudinal length thereof which can be slidably positioned within a cylindrical groove 24 formed in the second longitudinal side of the support plate 12. Preferably, the entire device 10 is constructed of a resilient plastic material, wherein the cylindrical projection 22 can either be slid into the cylindrical groove 24, or alternatively, snapped into the cylindrical groove through a resilient deformation of both the cylindrical projection 22 and the support plate 12 defining the cylindrical groove. The valance 20 extends both above and below the support plate 12, but extends predominantly below the support plate to effectively conceal or shroud the mounting plate 14 and/or the associated threaded fasteners or other mounting means which secure the device 10 to an associated surface.

With continuing reference to FIG. 3, as well as the rest of the figures, it can be shown that the present invention 10 includes at least one retaining channel 26 extending along the bottom surface of the support plate 12. Preferably, a pair of retaining channels 26 extend at a substantially spaced and parallel orientation along the bottom surface of the support plate 12. Each of the retaining channels 26 is defined by a quarter-round slot 28 extending through the support plate 12 which communicates with the bottom surface of the support plate by a rectangular slot 30 extending from the bottom surface and into communication with the quarter-round slot. By this structure, each of the retaining channels 26 is operable to receive and movably support a plurality of sliding hooks 32, as illustrated in FIG. 4.

Figure 4:
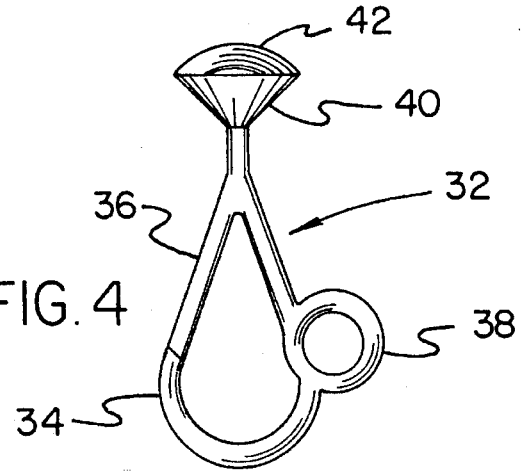
FIG. 4 is a side elevation view of a sliding hook forming a portion of the present invention.

With continuing reference to FIG. 4, it can be shown that each of the sliding hooks 32 is operable to support the upper end of an unillustrated curtain relative to the support plate 12. To this end, each of the sliding hooks 32 comprises a clip member 34 of substantially arcuate configuration including a resilient latch 36 permitting selective entrance into an interior of the clip member 34 whereby the sliding hook 30 can be coupled to an aperture in the unillustrated curtain. Further, the sliding hook 32 desirably includes a hook eye 38 of closed configuration projecting from the clip 34, wherein the hook eye 38 is operable to receive an unillustrated substantially U-shape coupling member commonly provided with curtain structures. The clip 34 is integrally or otherwise fixedly secured to a conical projection 40 having a hemispherical head 42. The conical projection 40 and the associated hemi-spherical head 42 are dimensioned so as to fit within the retaining channel 26, with the clip 34 projecting below the bottom surface of the support plate 12 through the rectangular slot 30 of the respective retaining channel 26. By this structure, a plurality of the sliding hooks 32 can be movably positioned within the retaining channels 26 and coupled to the upper portion of an unillustrated curtain to support the curtain relative to the support plate 12 and an associated wall or window structure.

To retain the sliding hooks 32 within the respective retaining channels 26, and to further conceal or disguise the transverse ends of the support plate 12, a pair of end caps 44 are removably coupled to respective transverse ends of the support plate. To this end, each of the end caps 44 includes spaced pairs of arcuate projections 46 which cooperate to frictionally and resiliently engage respectively opposed sides of the retaining channels 26. More specifically, the arcuate projections 46 are positioned so as to frictionally engage respectively opposed sides of the quarter-round slot 28 of each of the retaining channels 26, whereby such frictional engagement therebetween will retain the end caps 44 relative to the respective transverse ends of the support plate 12.

In use, the sliding holder for a curtain 10 provides a convenient alternative to conventional curtain rod structures and can be easily produced from any of the conventionally known plastic materials. The device 10 can then be secured to a wall surface or ceiling surface proximal to a window, with an associated curtain being subsequently coupled thereto as described above.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sliding curtain holder comprising:

a substantially elongated support plate having a first longitudinal side spaced from a second longitudinal side, the support plate including a pair of retaining channels extending in a substantially spaced and parallel orientation along a bottom surface of the support plate, each of the retaining channels being defined by a quarter-round slot extending longitudinally through the support plate which is accessible from the bottom surface of the support plate through a rectangular slot extending longitudinally from the bottom surface and a plurality of support plate apertures extending through the support plate which permit the direction of threaded fasteners therethrough which can engage and secure to a ceiling surface to join the support plate thereto;

a plurality of sliding hooks slidably positioned within the retaining channel for coupling to an upper end of a curtain with the sliding hooks comprising a clip member of a substantially arcuate configuration including a resilient latch permitting selective entrance into an interior of the sliding hook; a conical projection secured to the clip member, the conical projection having a hemi-spherical head, with the conical projection and the hemi-spherical head being positioned within the retaining channel and the clip member projecting below the bottom surface of the support plate through the rectangular slot of the retaining channel; and a hook eye of closed configuration projecting from the clip member opposite the latch;

a mounting plate coupled to and extending along the first longitudinal side of the support plate, the mounting plate extending in opposed directions both above and below the support plate and including a plurality of through extending mounting apertures which permit the direction of threaded fasteners therethrough to secure the mounting plate and the support plate relative to a vertical wall surface;

a valance removably coupled to the second longitudinal side of the support plate wherein the valance extends both above and below the support plate to effectively conceal the mounting plate and the threaded fasteners, the valance including a cylindrical projection extending along a longitudinal length thereof, with the second longitudinal side of the support plate being shaped so as to define a cylindrical groove, the cylindrical projection being positioned within the cylindrical groove formed in the second longitudinal side of the support plate for coupling the valance thereto; and a pair of end caps removably coupled to transverse ends of the support plate for concealing the transverse ends of the support plate and for retaining the associated sliding hooks in the retaining channels, the end caps including rectangular plates with spaced pairs of arcuate projections adapted to fictionally engage respectively opposed sides of the quarter-round slot of each of the retaining channels, whereby such frictional engagement therebetween retains the end caps relative to the respective ends of the support plate.

* * * * *